US010407776B2

(12) United States Patent
Kang et al.

(10) Patent No.: US 10,407,776 B2
(45) Date of Patent: Sep. 10, 2019

(54) METHOD AND SYSTEM FOR DIE COMPENSATION AND RESTORATION USING HIGH-VELOCITY OXY-FUEL THERMAL SPRAY COATING AND PLASMA ION NITRIDING

(71) Applicants: Hyundai Motor Company, Seoul (KR); Kia Motors Corporation, Seoul (KR); IUCF-HYU (Industry-University Cooperation Foundation Hanyang University), Seoul (KR)

(72) Inventors: Chul Ho Kang, Anyang-si (KR); Sang Hwan Jun, Suwon-si (KR); Deuk Yong Kim, Incheon (KR); Ga Young Park, Daejeon (KR); Gyu Yeol Bae, Incheon (KR); Chang Hee Lee, Seoul (KR)

(73) Assignees: Hyundai Motor Company, Seoul (KR); Kia Motors Corporation, Seoul (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 22 days.

(21) Appl. No.: 15/731,728

(22) Filed: Jul. 24, 2017

(65) Prior Publication Data

US 2017/0327956 A1 Nov. 16, 2017

Related U.S. Application Data

(62) Division of application No. 14/020,580, filed on Sep. 6, 2013, now Pat. No. 9,714,470.

(30) Foreign Application Priority Data

Mar. 5, 2013 (KR) ..... 10-2013-0023130

(51) Int. Cl.
*C23C 4/06* (2016.01)
*C23C 4/129* (2016.01)
(Continued)

(52) U.S. Cl.
CPC ..... *C23C 28/02* (2013.01); *C23C 4/02* (2013.01); *C23C 4/08* (2013.01); *C23C 4/129* (2016.01);
(Continued)

(58) Field of Classification Search
CPC .. C23C 4/06; C23C 4/08; C23C 4/129; C23C 4/18; C23C 8/02; C23C 8/36; C23C 8/38;
(Continued)

(56) References Cited

U.S. PATENT DOCUMENTS

2003/0106198 A1 6/2003 Kowalczyk
2010/0038142 A1* 2/2010 Snyder ..... E21B 4/02 175/107

(Continued)

FOREIGN PATENT DOCUMENTS

CN 101109083 A 1/2008
CN 102234754 A 11/2011

(Continued)

OTHER PUBLICATIONS

Lee, Jung Kul, "A Study on the Solid Particle Erosion Characteristics by Surface Treatment Process for 12wt%Cr Steel," University of Ulsan, Korea (2004).

(Continued)

*Primary Examiner* — Colleen P Dunn
*Assistant Examiner* — Anthony M Liang
(74) *Attorney, Agent, or Firm* — Morgan, Lewis & Bockius LLP

(57) ABSTRACT

A method and system for die compensation and restoration uses high-velocity oxy-fuel (HVOF) thermal spray coating and plasma ion nitriding to compensate for a particular part (damaged part) of a press die that causes formation of fine curves at a door of a vehicle to restore it to its original state. A coating thickness quantification technique may precisely
(Continued)

compensate for the damaged part of the die that causes formation of the fine curves at the door of the vehicle in a circular form using HVOF thermal spray coating. A surface of the die may be nitrided using plasma ion nitriding after HVOF thermal spray coating is performed, so as to harden the surface of the die so that wear resistance and fatigue resistance of the die can be greatly improved and the hardfacing or overlay welding efficiency of the die can be increased.

2 Claims, 10 Drawing Sheets

(51) Int. Cl.

| | |
|---|---|
| ***C23C 8/36*** | (2006.01) |
| ***C23C 8/38*** | (2006.01) |
| ***C23C 28/02*** | (2006.01) |
| ***C23C 4/02*** | (2006.01) |
| ***C23C 4/08*** | (2016.01) |
| ***C23C 4/18*** | (2006.01) |
| ***C23C 8/02*** | (2006.01) |
| ***C23C 28/00*** | (2006.01) |

(52) U.S. Cl.
CPC ..... *C23C 4/18* (2013.01); *C23C 8/02* (2013.01); *C23C 8/38* (2013.01); *C23C 28/321* (2013.01); *C23C 28/34* (2013.01); *C23C 28/36* (2013.01)

(58) Field of Classification Search
CPC ..... C23C 28/02; C23C 28/021; C23C 28/30; C23C 28/32; C23C 28/321; C23C 28/34; C23C 28/36
See application file for complete search history.

(56) References Cited

U.S. PATENT DOCUMENTS

| | | | | |
|---|---|---|---|---|
| 2010/0266781 | A1* | 10/2010 | Kusinski | C23C 28/00 427/453 |
| 2010/0266788 | A1* | 10/2010 | Niccolls | B32B 1/08 428/34.1 |
| 2010/0266790 | A1* | 10/2010 | Kusinski | B32B 1/08 428/34.6 |
| 2011/0293849 | A1 | 12/2011 | Lembach et al. | |

FOREIGN PATENT DOCUMENTS

| | | | |
|---|---|---|---|
| JP | 4-314821 | A | 11/1992 |
| JP | 8-336844 | A | 12/1996 |
| JP | 2004-066277 | A | 3/2004 |
| JP | 2004-069048 | A | 3/2004 |
| JP | 2010-202926 | A | 9/2010 |
| KR | 0181784 | B1 | 12/1998 |
| KR | 10-0683124 | B1 | 2/2007 |
| KR | 10-2007-0107966 | A | 11/2007 |
| KR | 10-0867277 | B1 | 11/2008 |

OTHER PUBLICATIONS

Su, Yong Qing, "Method for Restoring Corrosion and Wear of Offset Printer," China Academic Journal Electronic Publishing House, Dec. 2002.

Shibin Xu, *Nano-surface Technology*, Nano Surface Engineering, 2003, pp. 176-180, Chemical Industry Press, Beijing, China.

* cited by examiner

METHOD AND SYSTEM FOR DIE COMPENSATION AND RESTORATION USING HIGH-VELOCITY OXY-FUEL THERMAL SPRAY COATING AND PLASMA ION NITRIDING

CROSS-REFERENCE TO RELATED PATENT APPLICATION

The present application is a divisional of U.S. patent application Ser. No. 14/020,580, filed Sep. 6, 2013, which claims priority of Korean Patent Application Number 10-2013-0023130 filed Mar. 5, 2013, the entire contents of which applications are incorporated herein for all purposes by these references.

BACKGROUND OF INVENTION

Field of Invention

The present invention relates to a method and system for die compensation and restoration using high-velocity oxy-fuel (HVOF) thermal spray coating and plasma ion nitriding, and more particularly, to a method and system for die compensation and restoration using HVOF thermal spray coating and plasma ion nitriding, whereby a particular part (damaged part) of a press die that causes formation of fine curves at a door of a vehicle, may be compensated for and restored to its original state.

Description of Related Art

Vehicle design has been regarded as important as performance to meet consumers' needs. Thus, there has been a need for the development of a hard-to-form production technique to implement complicated curved surface design for vehicles.

One such example is a cover panel of a vehicle is manufactured using a press die.

However, when the cover panel of the vehicle is manufactured using the press die, a defect, such as a fine curve (see FIG. 1), occurs in the cover panel of the vehicle due to a tension balance difference formed on the cover panel of the vehicle by a damaged part of the surface of the die.

Thus, as an example of the related art for compensating for a fine curve formed on the cover panel, a compensation (repair) method, whereby a damaged part of the die is restored to its original shape by performing hardfacing or overlay welding, such as arc welding, using a welding rod at the damaged part of the die, has been implemented.

However, when welding is performed on the damaged part of the die, it is difficult to control welding thickness, and thermal deformation of a substrate occurs, and a period for hardfacing or overlay welding is long, and a plurality of compensation numbers are required to perform precise dimensioning on the damaged part of the die.

In addition, the surface of the die that is restored by hardfacing or overlay welding, such as arc welding, is plated with chromium. However, it is not easy to control the thickness of the chromium plating layer, and due to a hardness difference in surface caused by the thickness of the plating layer, when the die is heated and vertical operations are repeatedly performed several thousands of times with a strong pressure during a press work, the plating layer is inevitably peeled off, and the die should be periodically re-plated.

It is difficult to use such a chromium plating method at 400□ or more, and due to a carcinogenic material having stronger toxicity than arsenic (As) or cadmium (Cd), such as $Cr^{6+}$, environmental problems may occur during manufacture.

In order to solve the above-mentioned disadvantages of the compensation method of the die using hardfacing or overlay welding, a repair technique for alloying the damaged part of the die with high strength by repeatedly performing operations supplying metal powder to the damaged part of the die at a predetermined height, irradiating laser beams with low heat input onto the damaged part of the die at high velocity so as to form a molten part and simultaneously rapidly cooling the molten part by cooled air, is disclosed in Korean Patent Application Publication No. 10-2001-0067981 (published on Jun. 22, 2011).

However, the technique for repairing a local part of the die using laser beams with low heat input has overcome the disadvantages of hardfacing or overlay welding, such as arc welding; however, since an one-time stacking height of the metal powder is in the range of 0.8 to 1.2 mm, the technique is not suitable for a technique for compensating for a fine curve of the die that requires a compensation technique in units of micrometer, and due to an increase in manufacturing costs and hardfacing or overlay welding time caused by an additional rapid cooling process for high-strength alloying, efficiency is lowered.

As another die restoration method according to the relate art, a die restoration method including an ion-nitrided surface is disclosed in Korean Patent Application Publication No. 10-2007-0107966 (published on Nov. 8, 2007).

However, it is just adopted to include the ion-nitrided surface formed by ion nitriding that is an eco-friendly technique by replacing a die restoration method using chromium plating according to the related art. A detailed material for a hardfacing or overlay welding layer and types of dies and detailed conditions for an ion nitriding process and their procedures are not disclosed in the above reference and thus the effect of die restoration is insignificant.

As other related arts, a tungsten inert gas (TIG) welding or mixture powder coating method is used to repair a die manufactured using thermally spray-formed steel, or a technique for partially performing hardfacing or overlay welding by forming a low-temperature spray coating layer on a repair part of the die manufactured using thermally spray-formed steel and then by applying electric welding or low-temperature spray stacking process, is used.

However, there is no example in which a partial compensation technique using spray coating stacking is applied to a press die manufactured using spheroidal graphite cast iron (material containing a small amount of magnesium (Mg) in which graphite exists in a spheroidal form and which has improved strength and flexibility compared to general gray cast iron) as a substrate. Therefore, the development of the partial compensation method of the die manufactured using spheroidal graphite cast iron is urgently required.

The information disclosed in this Background section is only for enhancement of understanding of the general background of the invention and should not be taken as an acknowledgement or any form of suggestion that this information forms the prior art already known to a person skilled in the art.

BRIEF SUMMARY

The present invention provides for methods and systems for die compensation and restoration using high-velocity oxy-fuel (HVOF) thermal spray coating and plasma ion nitriding, whereby a particular part of a die is hardfacing or overlay welded by stacking ferro-alloy powder on a particular part (damaged part) of a press die manufactured using spheroidal graphite cast iron that causes formation of fine curves at a door of a vehicle using HVOF thermal spray coating, the hardfacing or overlay welded part is ion-nitrided to form a nitriding layer on a surface of the die and simultaneously, to form a nitrogen diffusion layer to a depth of a coating layer formed by ferro-alloy powder so that wear resistance and fatigue resistance of the die may be greatly improved and the hardfacing or overlay welding efficiency of the die manufactured of spheroidal graphite cast iron may be increased.

According to an aspect of the present invention, there is provided a method for die compensation and restoration using high-velocity oxy-fuel (HVOF) thermal spray coating and plasma ion nitriding, the method including: forming a ferro-alloy powder coating layer on a damaged part of a press die in which spheroidal graphite cast iron is used as a substrate, using HVOF thermal spray coating; and forming a nitriding layer on the coating layer by nitriding a surface of the coating layer of the press die using plasma ion nitriding.

As the die uses spheroidal graphite cast iron as the substrate, a coating material used in HVOF thermal spray coating may be one selected from the group consisting of commonly-used ferro-alloy FE-101 powder, FE-206 powder, and FE-108 powder.

The ferro-alloy powder may be adopted with an average diameter in a range of 25 to 35 μm.

The method may further include controlling surface roughness of a surface of the damaged part of the die as a pre-treatment process before HVOF thermal spray coating is performed.

The controlling of surface roughness may be performed using sand shot-blasting, and the surface roughness may be controlled to satisfy the equation Ra=5.63±0.41 μm or more.

HVOF thermal spray coating may be performed in a condition in which a melting temperature of powder particles is optimized by adjusting an increase/decrease in an oxygen flow and a fuel flow.

In particular, a nitriding layer having a thickness of 17 to 50 μm may be formed on the ferro-alloy powder coating layer using plasma ion nitriding.

The nitriding layer may include a nitrogen diffusion layer formed at a depth part of the coating layer and a nitrogen compound layer including CrN, $Fe_4N$, and $Fe_{2-3}N$ that constitute a surface of the die on an upper part of the nitrogen diffusion layer.

The method may further include, before performing plasma ion nitriding, grinding a surface of the coating layer up to #1000 to #2000 and removing impurities from the coating layer using alcohol ultrasonic cleaning.

Plasma ion nitriding may be performed by adjusting time, temperature, voltage, and gas ratio that determine a tissue and a depth of the nitriding layer according to an usage environment and a requirement condition of the die.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
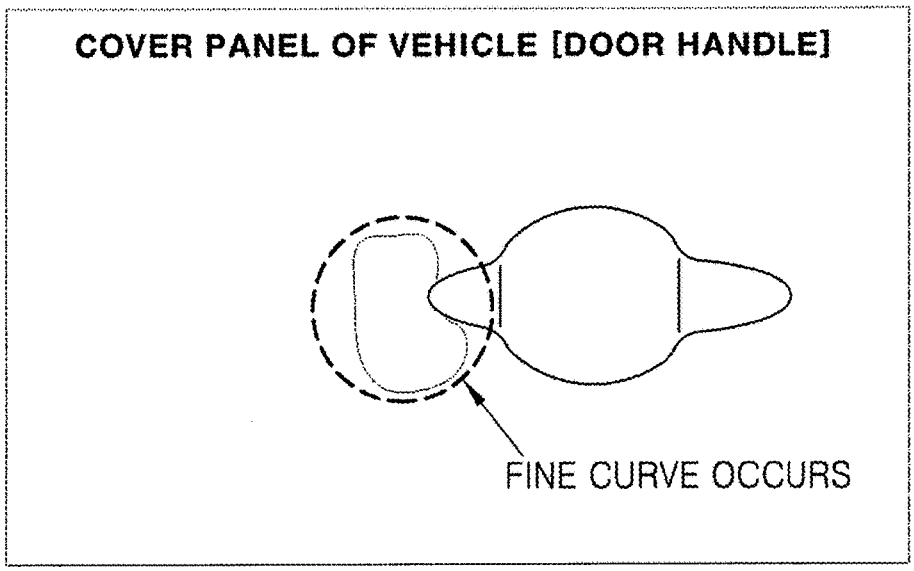
FIG. 1 is an image showing an example in which fine curves are formed at a cover panel of a door of a vehicle manufactured using a press die.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention provides a coating thickness quantification technique, whereby a damaged part of a press die manufactured of spheroidal graphite cast iron that causes formation of fine curves at a door of a vehicle may be precisely compensated for in a circular form using high velocity oxy-fuel (HVOF) thermal spray coating. The present invention also provides a method and system for die compensation and restoration using HVOF thermal spray coating and plasma ion nitriding, whereby a surface of the die is nitrided using plasma ion nitriding after HVOF thermal spray coating is performed, so as to harden the surface of the die so that wear resistance and fatigue resistance of the die may be greatly improved and the hardfacing or overlay welding efficiency of the die may be increased.

To this end, first, coating powder that is suitable for spheroidal graphite cast iron as a substrate for a press die is selected.

A commonly-used ferro-alloy (stainless steel) group that is a coating material used in HVOF thermal spray coating, represents mutual suitability with spheroidal graphite cast iron as the substrate for the press die and high mechanical characteristics (hardness, wear resistance, and bonding strength) compared to the substrate and is as shown in the following Table 1 in consideration of surface nitriding after coating is performed, may be selected.

TABLE 1

| No. | Model | Chemical Composition [wt %] | Remark |
|---|---|---|---|
| 1 | FE-101 | Fe—17Cr—12Ni—2.5Mo | 316 SS |
| 2 | FE-206 | Fe—16.1Cr—4.1Ni—3.2Cu—0.3Nb | 17-4 PH [Duplex] |
| 3 | FE-108 | Fe—12.5Cr | 410 SS |

FE-101 powder among the commonly-used ferro-alloy group selected, as shown in Table 1, is an austenite stainless steel material, has high low-temperature spray coating efficiency, realizes deformation hardening using process control and grain reinforcement using grain refinement, thereby improving coating strength characteristics.

Also, FE-206 powder in Table 1 is a martensite-type precipitation hardening stainless steel material and has the effect of hardening a diffused Cu precipitate, and FE-108 powder is a martensite stainless steel material having high hardening performance.

After a powder material for HVOF thermal spray coating for compensation and restoration of the press die, i.e., iron-base alloy powder is selected, the diameter of ferro-alloy powder should be determined, because it is a significant factor for determining coating performance.

If the diameter of ferro-alloy powder is too small and is less than 15 μm, powder is fully molten, and a laval nozzle for HVOF thermal spray coating is clogged so that coating may not be performed.

Figure 2:
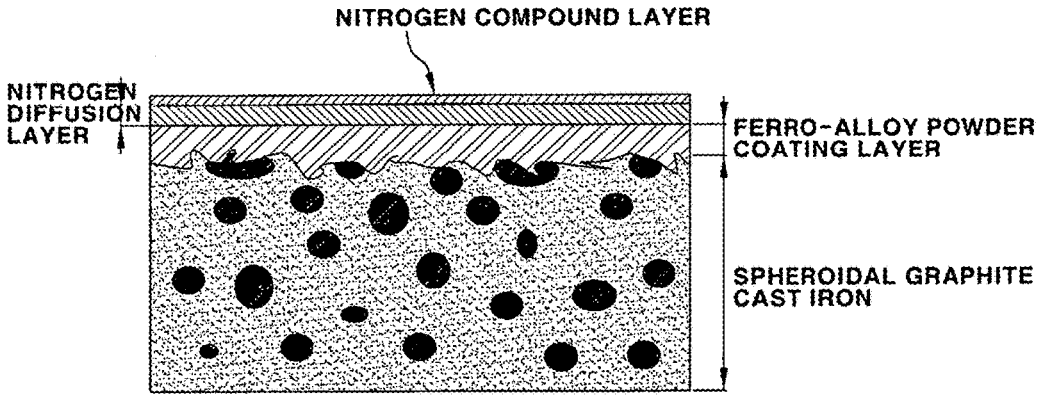
FIG. 2 is a schematic view of an exemplary stack structure of a coating layer of a die using high-velocity oxy-fuel (HVOF) thermal spray coating and plasma ion nitriding according to the present invention.

On the other hand, if the diameter of ferro-alloy powder is too large and is greater than 35 μm, gas for HVOF thermal spray coating does not sufficiently accelerate powder particles so that particle coating may not be well performed, and the coated particles form a weak interface between particles due to unmelting and pores so that cracks occur and a coating layer may be peeled off (see FIG. 2).

Thus, in the present invention, the average diameter of ferro-alloy powder used in fine curve compensation of the die may be set in the range of 25 to 35 μm.

When a material for powder used in HVOF thermal spray coating for compensation and restoration of the press die is selected and the diameter of the powder material is determined in this way, a process of controlling surface roughness as a pre-treatment process on a coating surface of the die is performed.

The reason why surface roughness of a surface (surface of a damaged part) on which a coating layer of the die is to be formed is controlled is to secure the bonding strength of the coating layer.

To this end, a sand shot-blasting process is performed as a pre-treatment process before HVOF thermal spray coating is performed so that surface roughness for coating of the die may be controlled.

More specifically, a sand shot-blasting process as an essential pre-treatment process for securing adhesion performance between a substrate and the coating layer of the die, a high bonding strength and durability, is performed so that a predetermined bonding strength between the substrate and the coating layer of the die with predetermined surface roughness may be maintained and simultaneously a dense interface therebetween may be formed.

The surface roughness of the substrate (spheroidal graphite cast iron) using the sand shot-blasting process may satisfy the equation Ra=5.63±0.41 μm or more, because in case of Ra=5.63±0.41 μm or less, a relative low bonding strength is maintained and cracks occur between the substrate and the coating layer.

Thus, as a pre-treatment process before coating is performed using HVOF thermal spray coating according to the present invention, surface roughness of the surface of the damaged part of the die is controlled by a surface roughness controller using sand shot-blasting.

Figure 3:
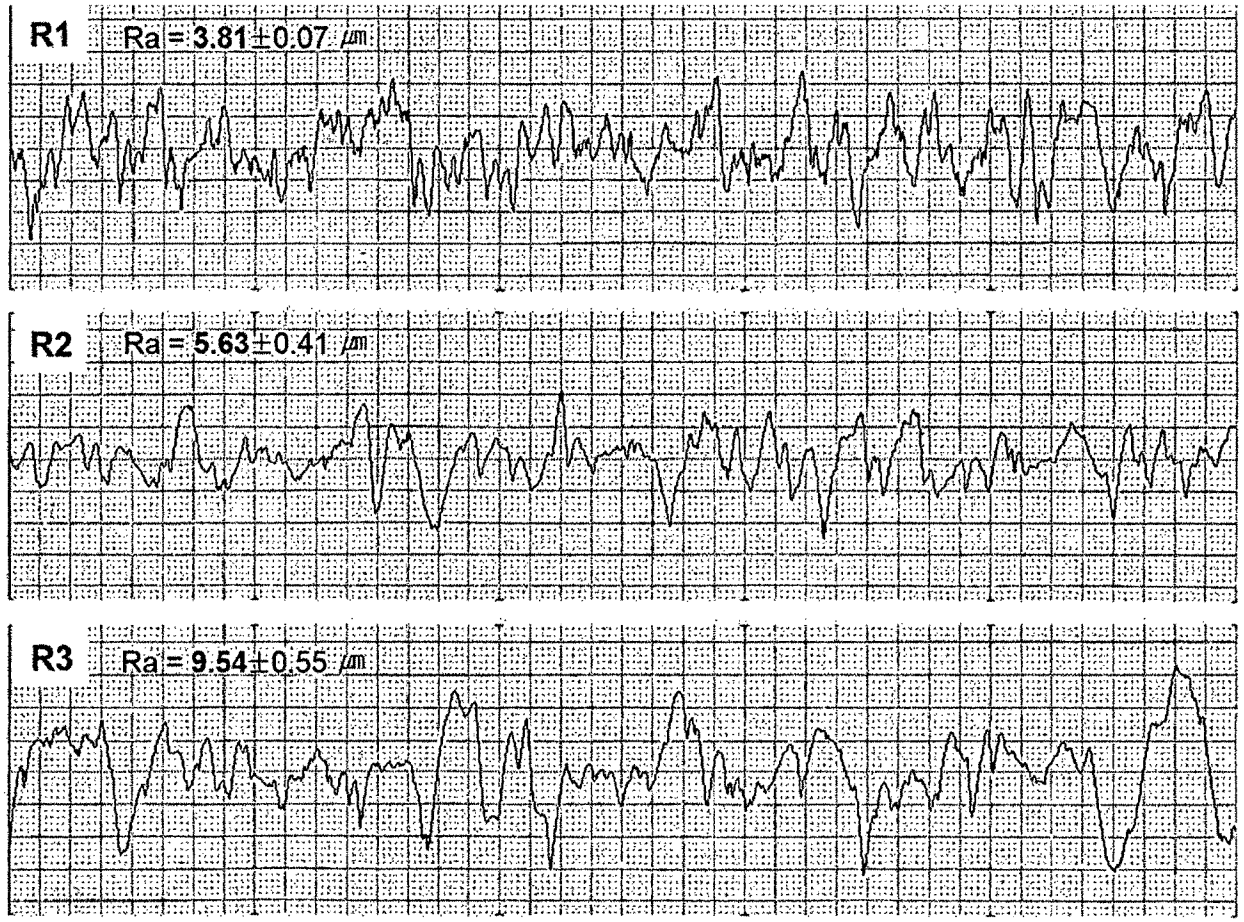
FIG. 3 is a view illustrating surface roughness of spheroidal graphite cast iron for forming a dense interface between a die and a coating layer.
Figure 4:
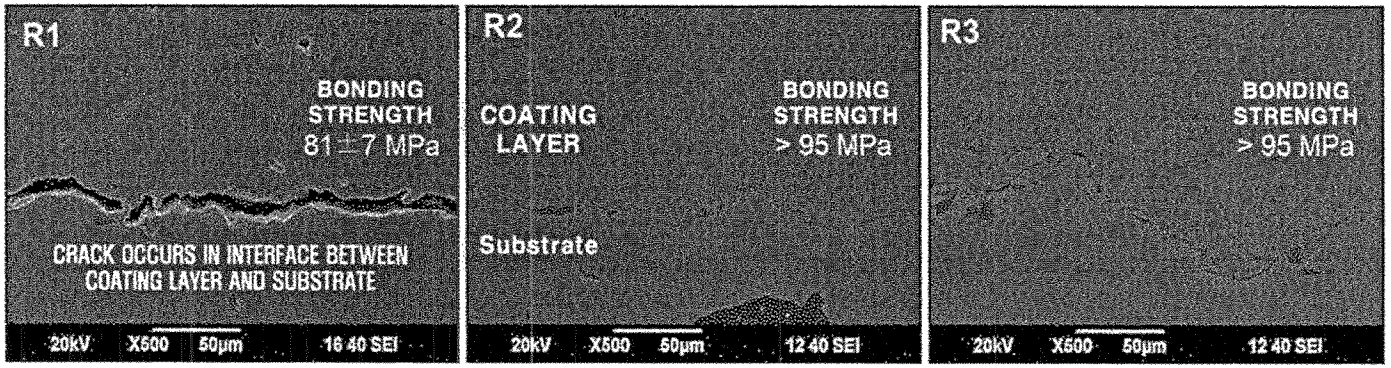
FIG. 4 is images of a stacking example of ferro-alloy powder coated on the die (spheroidal graphite cast iron), an adhesion force between the coating layer and the die and a bonding strength thereof according to surface roughness.

As an Experimental Example for controlling surface roughness of the die substrate according to the present invention, the sand shot-blasting process was performed on the die substrate so that surface roughness may satisfy the equations R1=3.81±0.47 μm, R2=5.63±0.41 μm, and R3=9.54±0.55 μm, as shown in FIG. 3, a coating layer was formed on the die substrate using HVOF thermal spray coating, and its result is as shown in FIG. 4.

As shown in FIG. 4, when surface roughness of the substrate (spheroidal graphite cast iron) using the sand shot-blasting process satisfies the equation R1=3.81±0.47 μm, cracks may occur in the interface between the coating layer and the substrate, and on the other hand, when surface roughness of the substrate (spheroidal graphite cast iron) using the sand shot-blasting process satisfies the equation R2=5.63±0.41 μm or more, a dense interface between the substrate and the coating layer may be formed.

Thus, the sand shot-blasting processing is performed so that surface roughness of the die substrate (spheroidal graphite cast iron) may satisfy the equation R2=5.63±0.41 μm or more.

Next, a process of forming the coating layer is performed on the surface of the damaged part of the die substrate having predetermined surface roughness using HVOF thermal spray coating.

That is, an operation of forming a ferro-alloy powder coating layer on the damaged part of the press die in which spheroidal graphite cast iron is used as a substrate, is performed using an HVOF thermal spray coating method performed by an HVOF thermal spray coating unit.

To this end, an optimum coating process condition for repairing the press die should be established.

That is, in the HVOF thermal spray coating method, the flying speed and temperature of powder is controlled by controlling pressures and flows of fuel and gas so that stacking efficiency of coating may be determined and coating fine tissue characteristics, such as adhesion performance between the coating layer and the substrate and air porosity thereof, may be determined. Thus, in order to form a die compensation coating layer having excellent characteristics, process optimization on type, pressure and flow conditions of fuel and gas should be established, and simultaneously, optimized process condition suitable for mass production for forming the coating layer should be established.

In this case, equipment JP-5000 manufactured by the TAFA company was used in the HVOF thermal spray coating method, and in order to draw optimum process parameters, as shown in the following Table 2, coating was performed by increasing/decreasing an oxygen flow and a fuel flow based on process parameters (condition C2) of coating powder that is provided to technical data of TAFA that is a manufacturer of HVOF thermal spray coating equipment JP-5000.

TABLE 2

| Parameters | C1 | C2 | C3 |
|---|---|---|---|
| Gun barrel | 4" | 4" | 4" |
| Spray distance | 14" [355 mm] | 14" [355 mm] | 14" [355 mm] |
| Spray speed | 300 mm/s | 300 mm/s | 300 mm/s |
| Spray pitch | 5 mm | 5 mm | 5 mm |
| Spray rate | 76 g/min | 76 g/min | 76 g/min |
| Oxygen flow | 1700 scfh | 1800 scfh | 2000 scfh |
| Fuel flow | 5.1 gph | 5.1 gph | 6 gph |
| Carrier gas [$N_2$] | 20 ± 2 scfh | 20 ± 2 scfh | 20 ± 2 scfh |

In the HVOF thermal spray coating method according to the present invention, kerosene is used as a fuel, powder is heated and accelerated using a high-temperature and high-velocity gas that is generated when kerosene is mixed with oxygen and is combusted, and power collides with the die, thereby performing coating.

Figure 9:
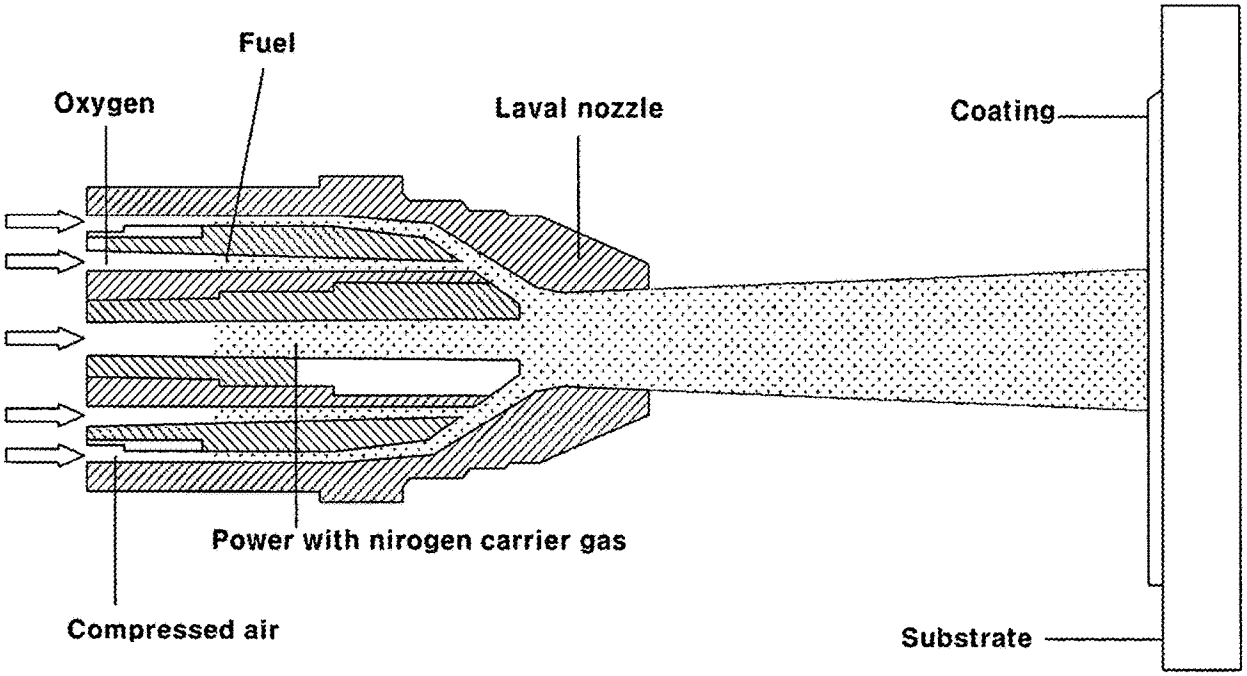
FIG. 9 is a schematic view of an exemplary structure of a spray gun used in HVOF thermal spray coating according to the present invention.

Referring to FIG. 9, the HVOF thermal spray coating method is performed using a spray gun in which a path on which fuel and oxygen are transported and a path on which metal powder (see Table 1) together with a nitrogen carrier gas is transported are formed.

Thus, after powder is heated and accelerated by the high-temperature and high-velocity gas generated when kerosene is mixed with oxygen and is combusted, powder is sprayed through the laval nozzle of the spray gun and simultaneously collides with the die, thereby forming a coating layer.

Also, nitrogen is used as a carrier gas while the HVOF thermal spray coating method is performed, and cooling of the substrate of the die is performed in an air-cooled manner without an external cooling device.

Thus, as shown in FIG. 2, a ferro-alloy powder coating layer is formed on the surface of the substrate of the die manufactured of spheroidal graphite cast iron as a coating layer formed using the HVOF thermal spray coating method.

In this case, a fine tissue of the coating layer after the HVOF thermal spray coating method has been performed, includes splat in which well-molten particles are re-coagulated, extend long in a curve form and form a layer-shaped structure, unmolten particles, particles, of which surface is partially molten, pores, and debris having a fine grain shape that is divided into many parts due to collision when thermal spray coating is performed.

When the melting temperature of powder particles is in an optimum condition (process condition C2 of Table 2), the powder particles may collide with the substrate at high velocity and simultaneously may be properly diffused to form a lamella structure or splat.

On the other hand, when the melting temperature of the powder particles is higher than the optimum condition (process condition C2 of Table 2), i.e., in case of process condition C1 of Table 1, or when the melting temperature of the powder particles is lower than the optimum condition (process condition C2 of Table 2), i.e., in case of process condition C3 of Table 1, the powder particles have a fine structure with internal defects.

When the melting temperature of the powder particles is higher than the optimum condition (process condition C2 of Table 2), i.e., in case of process condition C1 of Table 1, phase transformation occurs due to an undesirable reaction, such as oxidation, in a high-temperature gas flow field so that an oxide, such as $Fe_3O_4$, is dominantly formed on the coating layer.

Figure 5A:
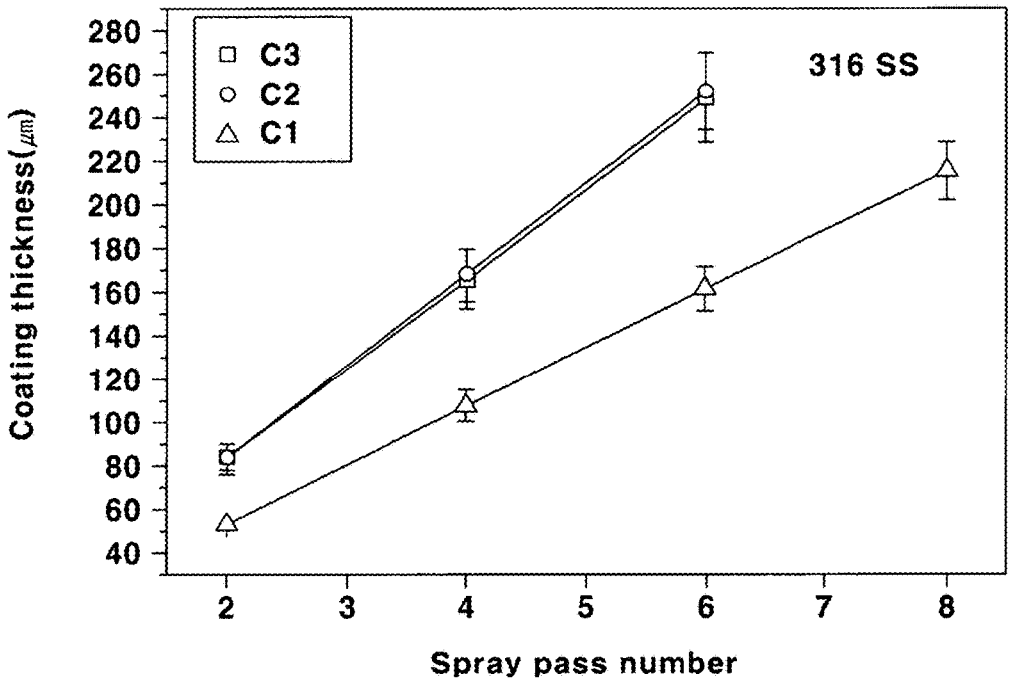
FIG. 5A, FIG. 5B and FIG. 5C are graphs showing examples of quantification of coating thicknesses of ferro-alloy powder according to the present invention
Figure 5B:
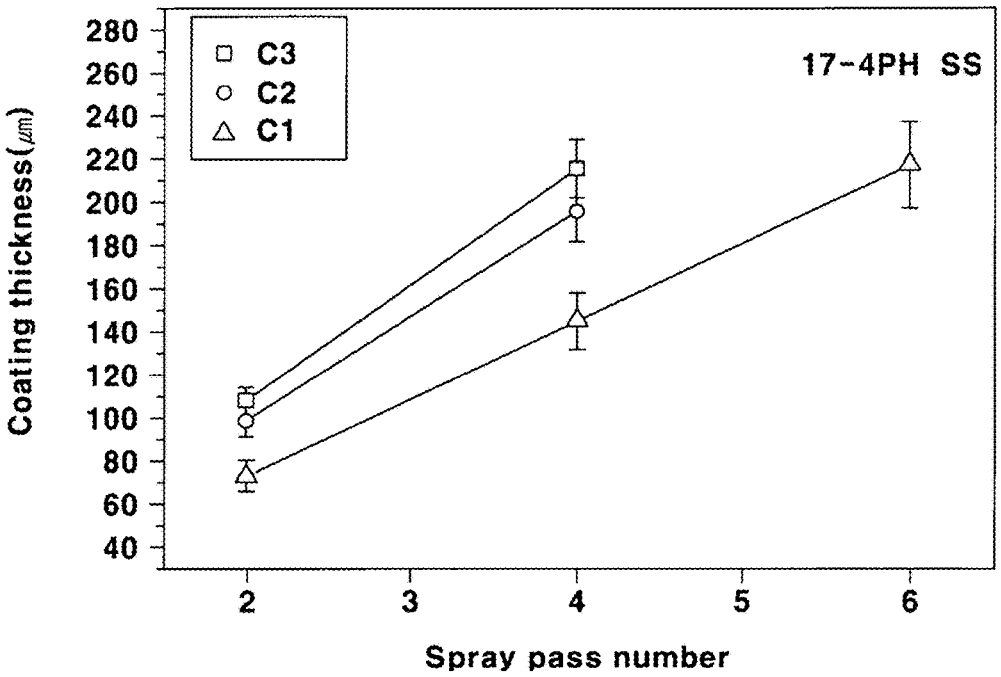
Figure 5C:
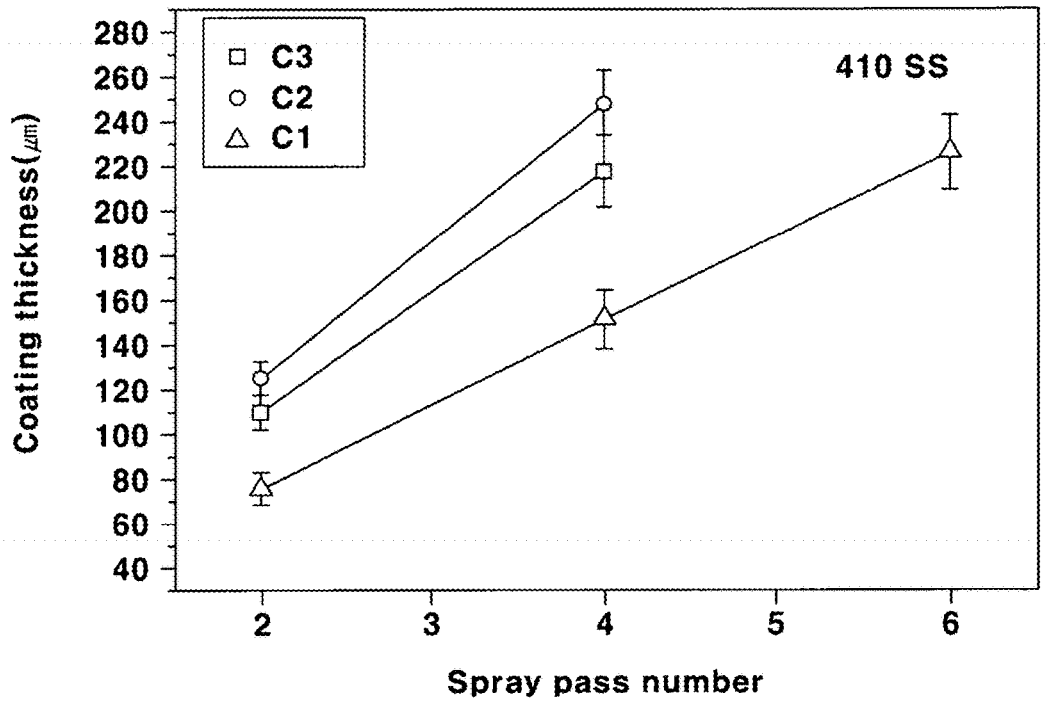

Since oxides that are dominantly formed on the coating layer constitute weak interfaces between the oxides and the powder particles due to a difference in thermal expansion coefficients during cooling, mechanical characteristics (microhardness and bonding strength) that are not uniform and weak in the coating layer, are generated. Also, since the instant fully-molten particles collide with the substrate and the fully-molten particles are widely diffused, the stacking efficiency of the coating layer (coating thickness compared to spray pass number) is not good, as indicated by C1 of FIGS. 5A through 5C.

On the other hand, when the melting temperature of the powder particles is higher than the optimum condition (process condition C2 of Table 2), i.e., in case of process condition C3 of Table 1, no sufficient heat is supplied to the powder particles and the unmolten particles collide with the surface of the die substrate and are stacked. Thus, an adhesion force between the particles is weak, and cracks are grown between weak interfaces of the particles so that the coating layer may be peeled off (see FIG. 4).

Thus, in the present invention, the HVOF thermal spray coating method is performed according to the process condition C2 (condition in which the melting temperature of the powder particles is optimized) shown in the above Table 2 so as to optimize the fine tissue of the coating layer formed using the HVOF thermal spray coating method and the stacking efficiency of powder.

More specifically, the HVOF thermal spray coating method is performed according to the process condition C2 (condition in which the melting temperature of the powder particles is optimized) including barrel of 4" of the spray gun, spray distance of 14" with respect the die substrate, spray speed of 300 mm/s, spray pitch of 5 mm, spray rate 76 g/min, oxygen flow of 1800 standard cubic feet per hour (scfh), fuel flow of 5.1 gallon per hour (gph), and carrier gas ($N_2$) of 20±2 scfh.

Next, a surface hardening process of the coating layer coated on the damaged part of the die is performed using plasma ion nitriding.

That is, the surface of the coating layer of the die is nitrided using plasma ion nitriding performed by a plasma ion nitriding unit so as to perform surface hardening. Thus, an operation of forming a nitriding layer on the coating layer may be performed.

Figure 6:
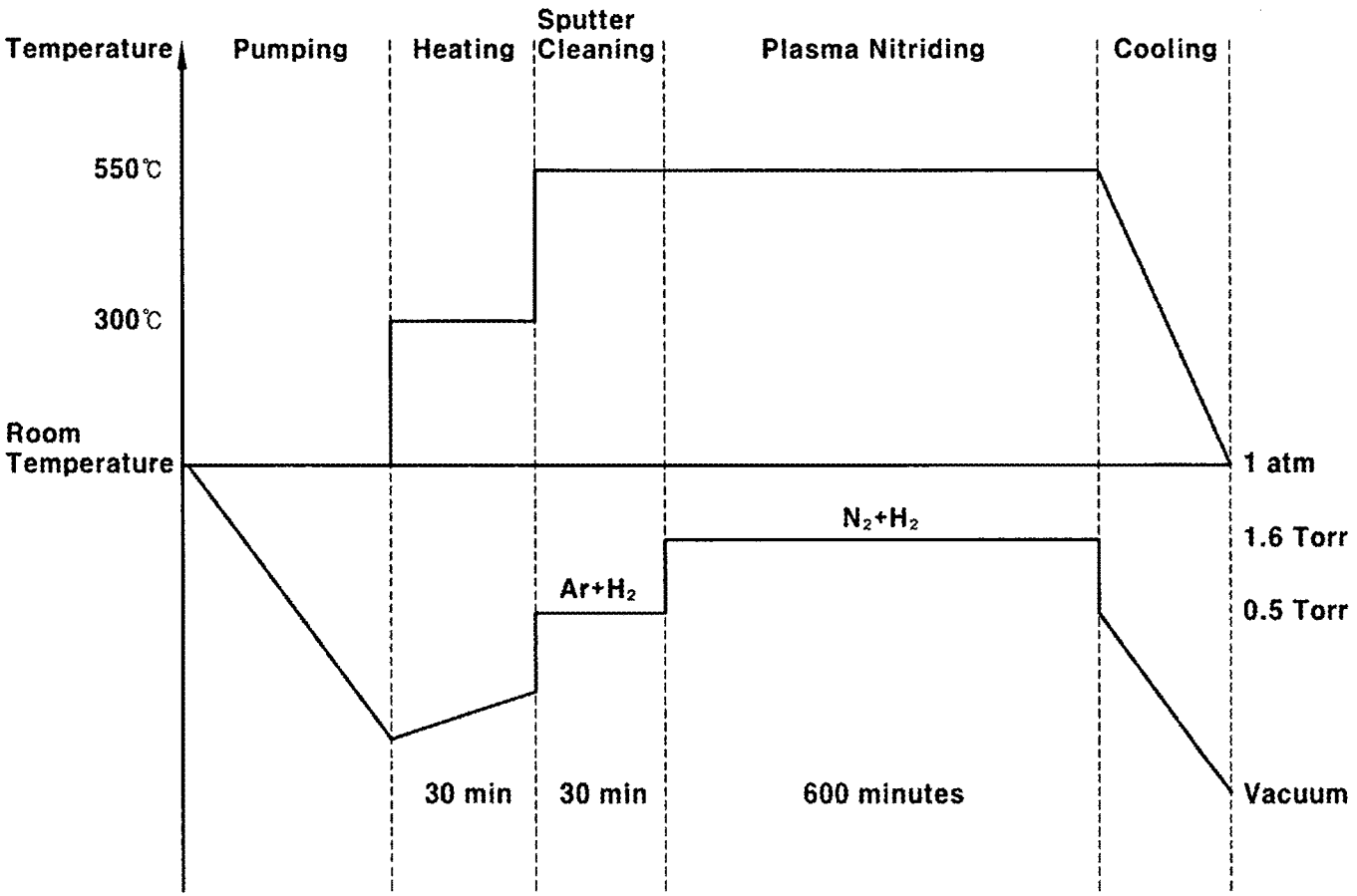
FIG. 6 is a view illustrating an exemplary plasma ion nitriding process according to the present invention.

Referring to FIG. 6, plasma ion nitriding for surface hardening and improving wear resistance of the coating layer coated on the surface of the compensated die, i.e., the damaged part of the die includes pumping in a nitriding reaction chamber, heating, sputter cleaning, plasma nitriding, and cooling.

The above processes will now be described in detail.

First, before plasma ion nitriding is performed, after the surface of the coating layer of the die compensated for using the optimum HVOF thermal spray coating method (process C2 of Table 2) is finely ground by a grinding unit using a silicon carbide (SiC) sandpaper up to #1000 to #2000, impurities are removed from the coating layer using alcohol ultrasonic cleaning by using a cleaning unit for 10 minutes.

Subsequently, after the die is loaded into the reaction chamber, the reaction chamber is pumped in a high vacuum state, voltage is applied to the surface of the die, the pressure of the reaction chamber is checked that it is decreased less than 1 torr and then, the reaction chamber is heated at 300□ for 30 minutes.

Next, in the sputter cleaning operation, when a voltage of 250 V is applied at a mixture gas atmosphere of Ar and $H_2$, plasma is formed, and a stable oxide layer, such as $Cr_2O_3$, formed on the coating layer may be removed by etching.

A nitriding process using plasma is performed using a mixture gas of $H_2$ and $N_2$, a process pressure of 1.6 torr, a fixed current of 30 A or more at 550□ for 10 hours, and cooling is slowly performed in a vacuum state.

Figure 7:
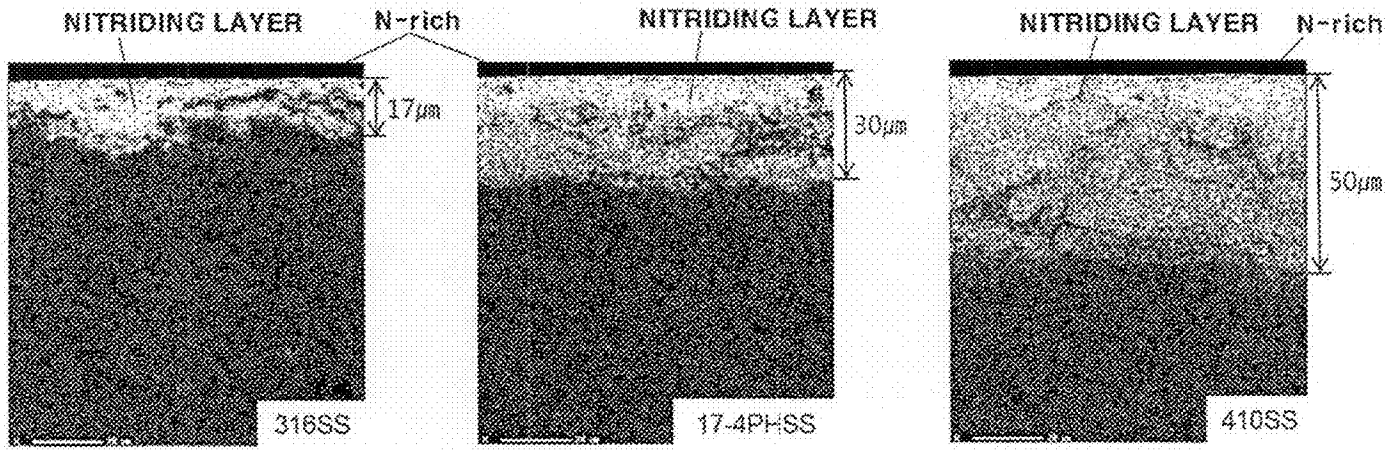
FIG. 7 is a cross-sectional view of nitrogen diffusion layers of cross-sections of an exemplary die to be repaired after the plasma ion nitriding process is performed according to the present invention.

Through the above processes, a nitriding layer (including a nitrogen diffusion layer and a nitrogen compound layer) having a thickness of about 17 to 50 μm is formed on the coating layer (ferro-alloy powder coating layer) coated by the HVOF thermal spray coating method, as shown in FIG. 7.

In addition, the nitrogen diffusion layer has been checked from a die product, of which surface is hardened by the nitriding process, using an electron probe micro analyzer (EPMA). Thus, as shown in FIG. 7, an N-rich region as a nitrogen compound layer may be checked from an upper part of the nitrogen diffusion layer.

That is, it may be checked that the N-rich region exists in the surface of the die and the nitrogen diffusion layer having a thickness of 17 to 50 μm is formed on a depth part of the coating layer according to steel types 316 SS, 17-4 PH, and 410 SS.

Figure 8:
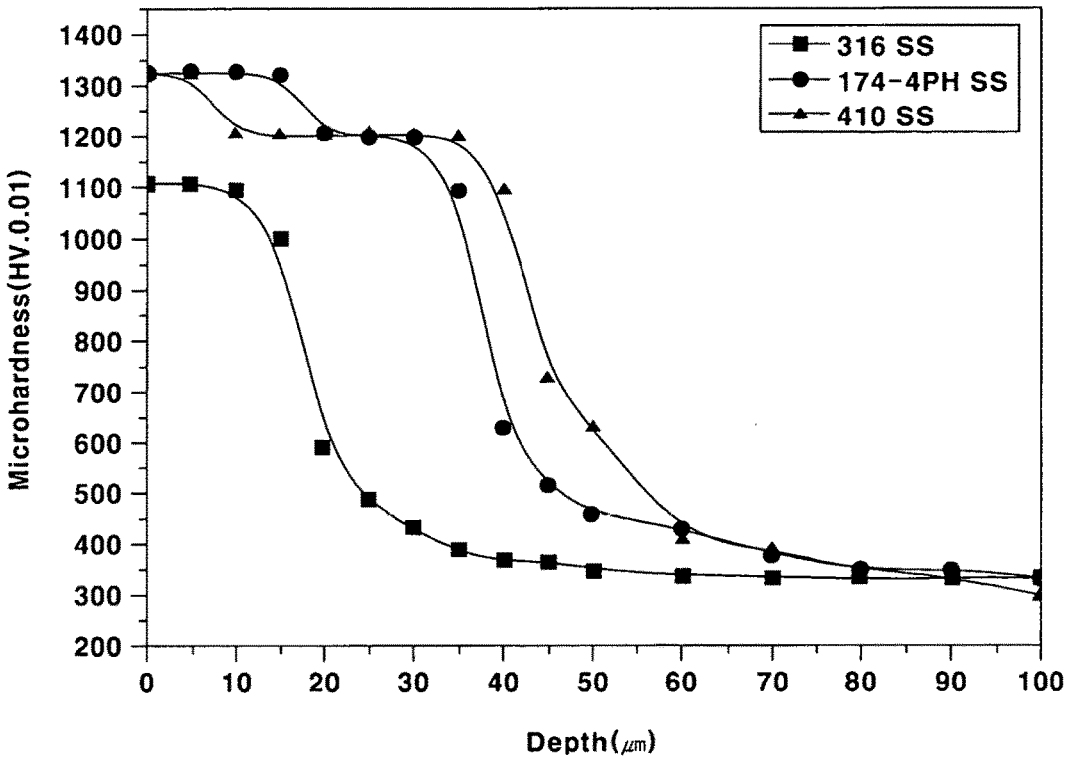
FIG. 8 is a graph of an exemplary profile of microhardness of a coating cross-section of the die to be repaired after the plasma ion nitriding process is performed according to the present invention.

Referring to FIG. 8, as a dense compound layer (N-rich region that is the nitrogen compound layer) including nitrides, such as CrN, $Fe_4N$, and $Fe_{2-3}N$, is formed on the upper part of the nitrogen diffusion layer, an excellent nitrogen hardening layer with Hv 1100 or more is formed, and hardness is increased due to the nitrogen diffusion layer formed according to the depth of the coating layer.

Although a method of forming a surface hardening layer using plasma ion nitriding has been described for surface hardening and improving wear resistance of the damaged part (repaired part) of the die according to the present invention, a surface to be restored of the repaired die using plasma ion nitriding may be used in various environments and conditions by adjusting time, temperature, voltage, and gas ratio that determine the tissue and depth of the nitriding layer.

As described above, the present invention provides the following effects.

According to the present invention, a particular part of a die is hardfacing or overlay welded by stacking ferro-alloy powder on a particular part (damaged part) of a press die formed of spheroidal graphite cast iron using an HVOF thermal spray coating technique, and the coating thickness of a coating layer is quantified and controlled in units of micron so that repair numbers for a precise dimensioning work can be reduced and production efficiency can be improved and production costs can be reduced.

In addition, in the HVOF thermal spray coating method, relatively low temperature stacking can be performed compared to a welding technique according to the related art, and thermal deformation of a substrate when the die is repaired can be minimized, unlike in arc welding according to the related art.

In particular, a nitriding layer including a nitrogen compound layer on the surface of the die and a nitrogen diffusion layer with the depth of the coating layer is formed by performing surface hardening on the repaired die using plasma ion nitriding so that wear resistance and fatigue resistance of the die can be improved, damage of the die can be suppressed and the usage life span of the die can be extended.

In addition, in plasma ion nitriding, a nitrogen gas can be ionized due to glow discharge. Thus, the die can be nitrided at a low temperature, and ammonia ($NH_3$) gas and nitrous oxide ($N_2O$) are not used so that eco-friendly nitriding can be performed.

In addition, it is efficient in nitriding aluminum, stainless steel, and cast iron that are metals that are not easily nitrided by performing oxide decomposition and surface activation of the surface of an object to be processed using a sputtering effect during a plasma ion nitriding process.

In addition, in plasma ion nitriding, the phase and thickness of a nitride formed in various process conditions (temperature, time, pressure, gas ratio) can be changed so that the surface characteristics of the die can be selectively changed according to characteristics and usage of the repaired die and the repair and restoration efficiency of the die can be improved.

For convenience in explanation and accurate definition in the appended claims, the terms upper and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A system for die compensation and restoration, the system comprising:

a high-velocity oxy-fuel (HVOF) thermal spray coating unit for forming a ferro-alloy powder coating layer on a damaged part of a press die in which spheroidal graphite east iron is used as a substrate, using a H VOF thermal spray coating;

a grinding unit for grinding a surface of the coating layer up to 1000-grit to 2000-grit;

a cleaning unit for removing impurities from the coating layer using alcohol ultrasonic cleaning; and a plasma ion nitriding unit for forming a nitriding layer on the ground and cleaned coating layer by nitriding a surface of the coating layer of the press die using plasma ion nitriding.

2. The system of claim 1, further comprising a surface roughness controller for controlling surface roughness of a surface of the damaged part of the die as a pre-treatment process before HVOF thermal spray coating is performed.

* * * * *